US007135424B2

(12) United States Patent
Worley et al.

(10) Patent No.: US 7,135,424 B2
(45) Date of Patent: Nov. 14, 2006

(54) COATED ARTICLES HAVING ENHANCED REVERSIBLE THERMAL PROPERTIES AND EXHIBITING IMPROVED FLEXIBILITY, SOFTNESS, AIR PERMEABILITY, OR WATER VAPOR TRANSPORT PROPERTIES

(75) Inventors: James Brice Worley, Westminster, CO (US); Mark Henry Hartmann, Superior, CO (US); Alan John Lekan, Boulder, CO (US); Monte Christopher Magill, Longmont, CO (US); Michael Alan Henshaw, Longmont, CO (US); Robert John Pushaw, Havertown, PA (US)

(73) Assignee: Outlast Technologies, Inc., Boulder, CO (US)

( * ) Notice: Subject to any disclaimer, the term of this patent is extended or adjusted under 35 U.S.C. 154(b) by 305 days.

(21) Appl. No.: 10/642,005

(22) Filed: Aug. 15, 2003

(65) Prior Publication Data

US 2004/0033743 A1 Feb. 19, 2004

Related U.S. Application Data

(63) Continuation of application No. 10/057,296, filed on Jan. 25, 2002, now abandoned.

(60) Provisional application No. 60/264,187, filed on Jan. 25, 2001.

(51) Int. Cl.
*B32B 5/32* (2006.01)

(52) U.S. Cl. ..... 442/131; 442/133; 442/136; 428/195.1; 428/206; 428/196; 428/913

(58) Field of Classification Search ..... 442/59, 442/131, 133; 428/141, 195.1, 310.5, 196, 428/206

See application file for complete search history.

(56) References Cited

U.S. PATENT DOCUMENTS

| | | | |
|---|---|---|---|
| 3,615,972 | A | 10/1971 | Morehouse, Jr. et al. |
| 3,665,157 | A | 5/1972 | Harada |
| 3,769,126 | A | 10/1973 | Koelek |
| 3,852,401 | A | 12/1974 | Suzuki et al. |
| 4,003,426 | A | 1/1977 | Best et al. |
| 4,006,273 | A | 2/1977 | Wolinski et al. |
| 4,094,685 | A | 6/1978 | Lester et al. |
| 4,111,189 | A | 9/1978 | Dizon |

(Continued)

FOREIGN PATENT DOCUMENTS

| | | |
|---|---|---|
| EP | 0111076 | 6/1984 |

(Continued)

OTHER PUBLICATIONS

Thermal Management Using 'Dry' Phase Change Materials, Wirtz, R.A., et al., made publicly available Mar. 9-11, 1999, Proc. Fifteenth IEEE Semiconductor Thermal Measurement and Management Symposium.*

(Continued)

*Primary Examiner*—Cheryl A. Juska
*Assistant Examiner*—Arden B. Sperty
(74) *Attorney, Agent, or Firm*—Cooley Godward LLP

(57) ABSTRACT

The invention relates to a coated article having enhanced reversible thermal properties. The coated article comprises a substrate having a surface and a coating covering a portion of the surface and comprising a polymeric material and a temperature regulating material dispersed in the polymeric material. The coating is formed with a plurality of regions of discontinuity that are separated from one another and expose a remaining portion of the surface to provide improved flexibility, softness, air permeability, or water vapor transport properties. The coated article may be used in apparel, footwear, medical products, containers and packagings, building materials, appliances, and other products.

10 Claims, 2 Drawing Sheets

U.S. PATENT DOCUMENTS

| | | | | |
|---|---|---|---|---|
| 4,122,203 | A | | 10/1978 | Stahl |
| 4,169,554 | A | | 10/1979 | Camp |
| 4,178,727 | A | | 12/1979 | Prusinski et al. |
| 4,208,485 | A | | 6/1980 | Nahta |
| 4,208,486 | A | | 6/1980 | Patton |
| 4,213,448 | A | | 7/1980 | Hebert |
| 4,219,072 | A | | 8/1980 | Barlow, Sr. |
| 4,237,023 | A | | 12/1980 | Johnson et al. |
| 4,258,696 | A | | 3/1981 | Gopal |
| 4,259,401 | A | | 3/1981 | Chahroudi et al. |
| 4,277,357 | A | | 7/1981 | Boardman |
| 4,290,416 | A | | 9/1981 | Maloney |
| 4,294,078 | A | | 10/1981 | MacCracken |
| 4,332,690 | A | | 6/1982 | Kimura et al. |
| 4,357,428 | A | | 11/1982 | Watson et al. |
| 4,360,442 | A | | 11/1982 | Reedt et al. |
| 4,403,644 | A | | 9/1983 | Hebert |
| 4,403,645 | A | | 9/1983 | MacCracken |
| 4,438,167 | A | | 3/1984 | Schwarz |
| 4,446,916 | A | | 5/1984 | Hayes |
| 4,462,390 | A | | 7/1984 | Holdridge et al. |
| 4,498,459 | A | | 2/1985 | Korin et al. |
| 4,504,402 | A | | 3/1985 | Chen et al. |
| 4,505,953 | A | | 3/1985 | Chen et al. |
| 4,510,193 | A | | 4/1985 | Blucher et al. |
| 4,513,053 | A | | 4/1985 | Chen et al. |
| 4,531,511 | A | | 7/1985 | Hochberg |
| 4,532,917 | A | | 8/1985 | Taff et al. |
| 4,560,385 | A | | 12/1985 | Baravian |
| 4,572,864 | A | | 2/1986 | Benson et al. |
| 4,581,285 | A | | 4/1986 | Mahefkey, Jr. |
| 4,585,572 | A | | 4/1986 | Lane et al. |
| 4,587,279 | A | | 5/1986 | Salyer et al. |
| 4,587,404 | A | | 5/1986 | Smith |
| 4,612,239 | A | | 9/1986 | Dimanshteyn et al. |
| 4,615,381 | A | | 10/1986 | Maloney |
| 4,617,332 | A | | 10/1986 | Salyer et al. |
| 4,637,888 | A | | 1/1987 | Lane et al. |
| 4,645,613 | A | | 2/1987 | Harvey et al. |
| 4,690,769 | A | | 9/1987 | Lane et al. |
| 4,702,853 | A | | 10/1987 | Benson et al. |
| 4,708,812 | A | | 11/1987 | Hatfield |
| 4,711,813 | A | | 12/1987 | Salyer |
| 4,727,930 | A | | 3/1988 | Bruckner et al. |
| 4,746,479 | A | | 5/1988 | Hanaki et al. |
| 4,747,240 | A | * | 5/1988 | Voisinet et al. ..... 52/173.1 |
| 4,756,958 | A | | 7/1988 | Bryant et al. |
| 4,774,133 | A | | 9/1988 | Doree et al. |
| 4,797,160 | A | | 1/1989 | Salyer |
| 4,807,696 | A | | 2/1989 | Colvin et al. |
| 4,825,939 | A | | 5/1989 | Salyer et al. |
| 4,828,542 | A | | 5/1989 | Hermann |
| 4,851,291 | A | * | 7/1989 | Vigo et al. ..... 428/393 |
| 4,853,270 | A | | 8/1989 | Wycech |
| 4,856,294 | A | | 8/1989 | Scaringe et al. |
| 4,871,615 | A | | 10/1989 | Vigo et al. |
| 4,900,617 | A | | 2/1990 | Smith |
| 4,908,166 | A | | 3/1990 | Salyer |
| 4,908,238 | A | * | 3/1990 | Vigo et al. ..... 427/389 |
| 4,911,232 | A | * | 3/1990 | Colvin et al. ..... 165/104.17 |
| 4,924,935 | A | | 5/1990 | Van Winckel |
| 4,935,294 | A | | 6/1990 | Misevich et al. |
| 4,939,020 | A | | 7/1990 | Takashima et al. |
| 4,964,402 | A | | 10/1990 | Grim et al. |
| 4,983,798 | A | | 1/1991 | Eckler et al. |
| 4,988,543 | A | | 1/1991 | Houle et al. |
| 5,007,478 | A | | 4/1991 | Sengupta |
| 5,008,133 | A | | 4/1991 | Herbet et al. |
| 5,053,446 | A | | 10/1991 | Salyer |
| 5,069,358 | A | | 12/1991 | Avery, Jr. |
| 5,085,790 | A | | 2/1992 | Hormansdorfer |
| 5,106,520 | A | | 4/1992 | Salyer |
| 5,110,666 | A | * | 5/1992 | Menzel et al. ..... 428/196 |
| 5,115,859 | A | | 5/1992 | Roebelen, Jr. et al. |
| 5,141,079 | A | * | 8/1992 | Whitney et al. ..... 184/6.14 |
| 5,155,138 | A | | 10/1992 | Lundqvist |
| 5,202,150 | A | | 4/1993 | Benson et al. |
| 5,211,949 | A | | 5/1993 | Salyer |
| 5,220,954 | A | | 6/1993 | Longardner et al. |
| 5,224,356 | A | | 7/1993 | Colvin et al. |
| 5,254,380 | A | | 10/1993 | Salyer |
| 5,282,994 | A | | 2/1994 | Salyer |
| 5,290,904 | A | | 3/1994 | Colvin et al. |
| 5,356,853 | A | | 10/1994 | Ueno et al. |
| 5,360,826 | A | | 11/1994 | Egolf et al. |
| 5,366,801 | A | | 11/1994 | Bryant et al. |
| 5,370,814 | A | | 12/1994 | Salyer |
| 5,381,670 | A | | 1/1995 | Tippmann et al. |
| 5,386,701 | A | | 2/1995 | Cao |
| RE34,880 | E | | 3/1995 | Salyer |
| 5,415,222 | A | | 5/1995 | Colvin et al. |
| 5,424,519 | A | | 6/1995 | Salee |
| 5,435,376 | A | | 7/1995 | Hart et al. |
| 5,477,917 | A | | 12/1995 | Salyer |
| 5,499,460 | A | | 3/1996 | Bryant et al. |
| 5,501,268 | A | | 3/1996 | Stovall et al. |
| 5,507,337 | A | | 4/1996 | Rafalovich et al. |
| 5,532,039 | A | | 7/1996 | Payne et al. |
| 5,552,075 | A | | 9/1996 | Salyer |
| 5,565,132 | A | | 10/1996 | Salyer |
| 5,571,592 | A | | 11/1996 | McGregor et al. |
| 5,593,754 | A | * | 1/1997 | Blauer et al. ..... 428/131 |
| 5,609,954 | A | | 3/1997 | Aizawa et al. |
| 5,626,936 | A | | 5/1997 | Alderman |
| 5,637,389 | A | | 6/1997 | Colvin et al. |
| 5,647,226 | A | | 7/1997 | Scaringe et al. |
| 5,669,584 | A | | 9/1997 | Hickey |
| 5,677,048 | A | | 10/1997 | Pushaw |
| 5,677,049 | A | | 10/1997 | Torii |
| 5,680,898 | A | * | 10/1997 | Rafalovich et al. ..... 165/236 |
| 5,687,706 | A | * | 11/1997 | Goswami et al. ..... 126/263.01 |
| 5,695,849 | A | * | 12/1997 | Shawver et al. ..... 428/131 |
| 5,722,482 | A | | 3/1998 | Buckley |
| 5,750,962 | A | | 5/1998 | Hyatt |
| 5,755,104 | A | * | 5/1998 | Rafalovich et al. ..... 62/81 |
| 5,755,216 | A | | 5/1998 | Salyer |
| 5,755,987 | A | | 5/1998 | Goldstein et al. |
| 5,755,988 | A | | 5/1998 | Lane et al. |
| 5,763,335 | A | | 6/1998 | Hermann |
| 5,765,389 | A | | 6/1998 | Salyer |
| 5,770,295 | A | | 6/1998 | Alderman |
| 5,785,884 | A | | 7/1998 | Hammond |
| 5,788,912 | A | | 8/1998 | Salyer |
| 5,804,297 | A | | 9/1998 | Colvin et al. |
| 5,851,338 | A | | 12/1998 | Pushaw |
| 5,884,006 | A | | 3/1999 | Frohlich et al. |
| 5,885,475 | A | | 3/1999 | Salyer |
| 5,897,952 | A | | 4/1999 | Vigo et al. |
| 5,899,088 | A | | 5/1999 | Purdum |
| 5,911,923 | A | | 6/1999 | Work et al. |
| 5,928,972 | A | * | 7/1999 | Mashiko et al. ..... 442/334 |
| 5,932,129 | A | | 8/1999 | Hyatt |
| 5,935,157 | A | | 8/1999 | Harmon |
| 5,948,707 | A | | 9/1999 | Crawley et al. |
| 5,955,188 | A | | 9/1999 | Pushaw |
| 5,976,400 | A | | 11/1999 | Muffett et al. |
| 5,997,762 | A | | 12/1999 | Haget et al. |
| 5,999,699 | A | | 12/1999 | Hyatt |
| 6,004,662 | A | | 12/1999 | Buckley |
| 6,025,287 | A | | 2/2000 | Hermann |
| 6,041,437 | A | | 3/2000 | Barker et al. |
| 6,047,106 | A | | 4/2000 | Salyer |
| 6,048,810 | A | | 4/2000 | Baychar |
| 6,077,597 | A | | 6/2000 | Pause |

| | | | | |
|---|---|---|---|---|
| 6,079,404 | A | 6/2000 | Salyer | |
| 6,099,555 | A | 8/2000 | Sabin | |
| 6,099,894 | A | 8/2000 | Holman | |
| 6,108,489 | A | 8/2000 | Frohlich et al. | |
| 6,109,338 | A | 8/2000 | Butzer | |
| 6,116,330 | A | 9/2000 | Salyer | |
| 6,119,573 | A | 9/2000 | Berens et al. | |
| 6,120,530 | A | 9/2000 | Nuckols et al. | |
| 6,125,645 | A | 10/2000 | Horn | |
| 6,136,217 | A | 10/2000 | Haget et al. | |
| 6,139,675 | A | 10/2000 | Druecke et al. | |
| 6,170,561 | B1 | 1/2001 | O'Grady | |
| 6,171,647 | B1 | 1/2001 | Holman | |
| 6,179,879 | B1 | 1/2001 | Robinson et al. | |
| 6,180,214 | B1 | 1/2001 | Nissing et al. | |
| 6,183,855 | B1 | 2/2001 | Buckley | |
| 6,185,742 | B1 | 2/2001 | Doherty | |
| 6,197,415 | B1 | 3/2001 | Holman | |
| 6,207,738 | B1 | 3/2001 | Zuckerman et al. | |
| 6,214,303 | B1 | 4/2001 | Hoke et al. | |
| 6,217,993 | B1 | 4/2001 | Pause | |
| 6,230,444 | B1 | 5/2001 | Pause | |
| 6,277,439 | B1 | 8/2001 | Painter | |
| 6,284,158 | B1 * | 9/2001 | Marshall et al. | 252/572 |
| 6,296,914 | B1 | 10/2001 | Kerins et al. | |
| 6,319,599 | B1 * | 11/2001 | Buckley | 428/308.4 |
| 6,660,667 | B1 * | 12/2003 | Zuckerman et al. | 442/131 |
| 6,689,466 | B1 * | 2/2004 | Hartmann | 428/402.2 |
| 6,793,856 | B1 * | 9/2004 | Hartmann et al. | 264/141 |
| 6,855,422 | B1 * | 2/2005 | Magill et al. | 428/373 |
| 2002/0132091 | A1 * | 9/2002 | Worley | 428/138 |
| 2003/0124278 | A1 * | 7/2003 | Clark et al | 428/35.7 |

FOREIGN PATENT DOCUMENTS

| | | |
|---|---|---|
| GB | 742295 | * 12/1955 |
| JP | SHO 53-34863 | 3/1978 |
| JP | SHO 56-30473 | 3/1981 |
| JP | SHO 63-217196 | 9/1988 |
| JP | HEI 5-156570 | 6/1993 |
| JP | HEI 5-247854 | 9/1993 |
| WO | WO 87/07854 | 12/1987 |
| WO | WO 93/15625 | 8/1993 |
| WO | WO 93/24241 | 12/1993 |
| WO | WO 95/29057 | 11/1995 |
| WO | WO 95/34609 | 12/1995 |
| WO | WO 97/43512 | 11/1997 |
| WO | WO 98/42929 | 10/1998 |
| WO | WO 98/45208 | 10/1998 |
| WO | WO 98/46669 | 10/1998 |
| WO | WO 99/25549 | 5/1999 |
| WO | WO 00/61360 | 10/2000 |
| WO | WO 00/65100 | 11/2000 |
| WO | WO 01/35511 | 5/2001 |
| WO | WO 01/38810 | 5/2001 |
| WO | WO 02/12607 | 2/2002 |

OTHER PUBLICATIONS

"Innovative Protective Clothing: PCM Microcapules as Barrier for Optimized Cold Protection", *Techtexil-Telegramm*, Mar. 28, 1994, pp. 2-3, Frankfurt, Germany.

"Fabrics given enhanced thermal properties", *Chemical & Engineering News*, p. 15, Oct. 20, 1986, Washington, DC.

George, K. and Shepard, M., "Phase Change Wallboard For Peak Demand Reduction", *Tech Memo*, © Aug. 1993, E Source, Inc., Boulder, Colorado.

"How to Wrap a Home in Energy Savings", Oct. 1993, Tyvek® Housewrap, DuPont, Wilmington, Delaware.

Search results obtained from a search of public computer patent databases (pp. 2-99) conducted Jul. 16, 1993.

Search results obtained from a search of public computer patent databases (pp. 5-51) conducted Jul. 19, 1993.

Search results obtained from a search of public computer patent databases (pp. 2-17) conducted Nov. 1, 1993.

"Material Safety Data Sheet—Microencapsulated N-Octadecane" effective date Jan. 31, 1992, Microtek Laboratories, Inc., Dayton, Ohio 45403.

"Material Safety Data Sheet—Microencapsulated Kenwax19—Filter Cake" effective date Nov. 29, 1994, Microtek Laboratories, Inc., Dayton, Ohio 45403.

Coating Equipment & Processes, http://www.etfinancial.com/coatingsequip.htm, printed Jan. 17, 2002, pp. 1-8.

Pasquale, John A., Roll-coating systems: Principles and uses, Converting Magazine, http://www.convertingmagazine.com/currentissue/current.cgi?view+12_01_36.htlm, printed Jan. 17, 2002, pp. 1-7.

* cited by examiner

COATED ARTICLES HAVING ENHANCED REVERSIBLE THERMAL PROPERTIES AND EXHIBITING IMPROVED FLEXIBILITY, SOFTNESS, AIR PERMEABILITY, OR WATER VAPOR TRANSPORT PROPERTIES

CROSS-REFERENCE TO RELATED APPLICATIONS

This application claims priority from and is a continuation of U.S. patent application Ser. No. 10/057,296, filed on Jan. 25, 2002 now abandoned, which claims the benefit of U.S. Provisional Application Ser. No. 60/264,187, filed on Jan. 25, 2001, the disclosures of which are incorporated herein by reference in their entirety.

FIELD OF THE INVENTION

The present invention relates to coated articles. More particularly, the present invention relates to coated articles having enhanced reversible thermal properties and exhibiting improved flexibility, softness, air permeability, or water vapor transport properties.

BACKGROUND OF THE INVENTION

Continuous coatings containing a phase change material have been applied to fabrics to provide enhanced reversible thermal properties to the fabrics themselves as well as to apparel or other products made therefrom. Typically, microcapsules containing a phase change material are mixed with a polymeric material to form a blend, and this blend is subsequently cured on a fabric to form a continuous coating covering the fabric. While providing desired thermal regulating properties, the continuous coating may lead to undesirable reductions in flexibility, softness, air permeability, and water vapor transport properties. A continuously coated fabric tends to be stiff and "boardy", and the relatively impermeable nature of the continuous coating may substantially diminish the ability of the continuously coated fabric to transport air or water vapor. When incorporated in apparel, such reduced properties of the continuously coated fabric can lead to an inadequate level of comfort for an individual wearing the apparel.

It is against this background that a need arose to develop the coated articles described herein.

SUMMARY OF THE INVENTION

In one innovative aspect, the present invention relates to a coated article having enhanced reversible thermal properties. In one exemplary embodiment, the coated article may comprise a substrate having a surface and a coating covering a portion of the surface and comprising a polymeric material and a temperature regulating material dispersed in the polymeric material. The coating may be formed with a plurality of regions of discontinuity that are separated from one another and expose a remaining portion of the surface to provide improved flexibility and air permeability to the coated article.

In another exemplary embodiment, the coated article may comprise a substrate having a surface and a coating covering a portion of the surface and comprising a polymeric material and a temperature regulating material dispersed in the polymeric material. The coating may be formed as a plurality of coating regions that are distributed substantially uniformly across the surface and are separated from one another to provide improved flexibility and air permeability to the coated article.

In yet another exemplary embodiment, the coated article may comprise a substrate having a surface and a coating covering a portion of the surface and comprising a polymeric phase change material. The coating may be formed in a pattern that exposes a remaining portion of the surface to provide improved flexibility and air permeability to the coated article.

BRIEF DESCRIPTION OF THE DRAWINGS

For a better understanding of the nature and objects of the invention, reference should be made to the following detailed description taken in conjunction with the accompanying drawings, in which.

DETAILED DESCRIPTION

The present invention relates to coated articles comprising one or more phase change materials and methods of manufacturing thereof. Coated articles in accordance with various embodiments of the invention have the ability to absorb or release thermal energy to reduce or eliminate heat flow. In conjunction with providing thermal regulating properties, the coated articles may exhibit improved flexibility, softness, air permeability, or water vapor transport properties. The coated articles may be particularly useful when incorporated in products to be worn or otherwise used by an individual to provide a greater level of comfort. For example, coated articles in accordance with embodiments of the invention may be used in apparel (e.g., outdoor clothing, drysuits, and protective suits), footwear (e.g., socks, boots, and insoles), and medical products (e.g., thermal blankets, therapeutic pads, incontinent pads, and hot/cold packs). In addition, the coated articles may find use in numerous other products to provide a thermal regulating property to these products. In particular, the coated articles described herein may be used in containers and packagings (e.g., beverage/food containers, food warmers, seat cushions, and circuit board laminates), building materials (e.g., insulation in walls or ceilings, wallpaper, curtain linings, pipe wraps, carpets, and tiles), appliances (e.g., insulation in house appliances), and other products (e.g., automotive lining material, sleeping bags, furniture, mattresses, upholstery, and bedding).

Coated articles in accordance with various embodiments of the present invention when incorporated, for example, in apparel or footwear may provide a reduction in an individual's skin moisture, such as, due to perspiration. For instance, the coated articles may lower the temperature or the relative humidity of the skin, thereby providing a lower degree of skin moisture and a higher level of comfort. The use of specific materials and specific apparel or footwear design features may further enhance this moisture reduction result.

Figure 1:
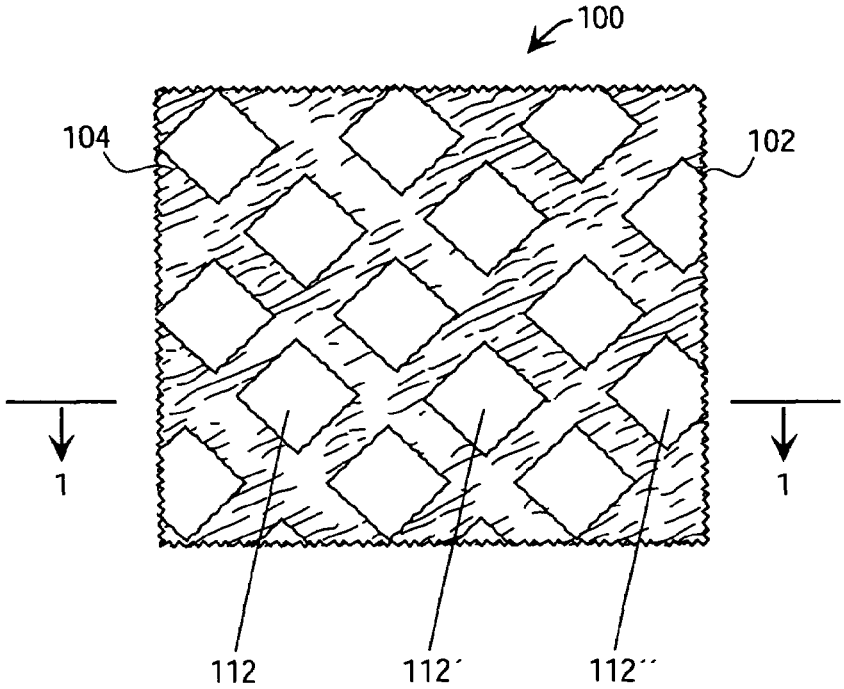
FIG. 1 illustrates a top sectional view of an exemplary coated article according to an embodiment of the invention.
Figure 2:
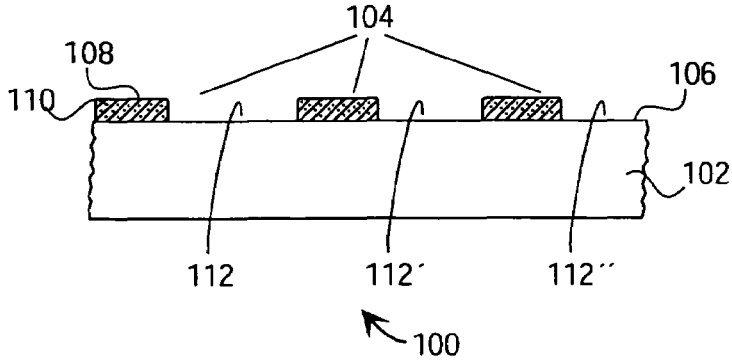
FIG. 2 illustrates a side sectional view of the exemplary coated article taken along line 1—1 of FIG. 1.

With reference to FIG. 1 and FIG. 2, an exemplary coated article 100 in accordance with an embodiment of the invention is illustrated. In particular, FIG. 1 illustrates a top view of a section of the coated article 100, and FIG. 2 illustrates a side view of this section taken along line 1—1 of FIG. 1.

The coated article 100 comprises a substrate 102 and a coating 104 covering at least a portion of the substrate 102. In general, virtually anything to which the coating 104 may be applied and for which enhanced reversible thermal properties are desired may be selected as the substrate 102. Depending on the particular application of the coated article 100, the substrate 102 may be selected based on its flexibility, softness, air permeability, or water vapor transport properties. In embodiments useful for clothing applications, the substrate 102 may have a level of flexibility, softness, air permeability, or water vapor transport properties that provides an adequate level of comfort during end use. By way of example and not limitation, the substrate 102 may be a fabric (e.g., a plaited, braided, twisted, felted, knitted, woven, or non-woven fabric), a film (e.g., a polymeric film), a foam (e.g., an open-celled or closed-cell foam), a leather, a paper, a sheet (e.g., a polymeric sheet), and so forth. For instance, the substrate 102 may be a fabric comprising a plurality of natural or synthetic fibers blended together by a knitted, woven, or non-woven process. As another example, the substrate 102 may be a semi-permeable film that is waterproof and that may contain microholes or passageways to facilitate transport of air or water vapor.

In the embodiment shown in FIG. 1 and FIG. 2, the coating 104 covers a portion of a surface 106 (e.g., a top surface) of the substrate 102. Depending on the particular characteristics of the substrate 102 or the coating 104 or method of forming the coated article 100, the coating 104 may extend below the surface 106 and permeate a portion of the substrate 102 (e.g., up to about 100 percent of the substrate 102). For instance, the substrate 102 may be an open-celled foam that is partially permeated by the coating 104 within cells of the foam, or the substrate 102 may be a fabric that is partially permeated by the coating 104 within interstices of the fabric. While the coating 104 is shown covering one surface of the substrate 102, it should be recognized that the coating 104 may, alternatively or in conjunction, cover one or more different surfaces of the substrate 102 (e.g., a bottom or side surface). The coating 104 may be formed from a polymeric material 108 that has a temperature regulating material 110 dispersed therein. The temperature regulating material 110 may be uniformly dispersed within the coating 104. However, depending upon the particular characteristics desired for the coated article 100, the dispersion of the temperature regulating material 110 may be varied within one or more portions of the coating 104. For instance, the temperature regulating material 110 may be concentrated in one or more portions of the coating 104 or distributed in accordance with a concentration profile along one or more directions within the coating 104. Typically, the temperature regulating material 110 will comprise one or more phase change materials that provide the coated article 100 with enhanced reversible thermal properties. If desired, the coating 104 may comprise one or more additional temperature regulating materials that differ in some fashion from the temperature regulating material 110 (e.g., different phase change materials). The one or more additional temperature regulating materials may be uniformly, or non-uniformly, dispersed within the coating 104.

As shown in FIG. 1 and FIG. 2, the coating 104 is formed in a crisscross pattern. This crisscross pattern comprises a first set of spaced apart coating regions (e.g., coating strips) that intersect a second set of spaced apart coating regions (e.g., coating strips) at an angle. In the present embodiment, the coating strips of the first set are generally parallel and evenly spaced from one another, and the coating strips of the second set are also generally parallel and evenly spaced from one another. The coating strips of the first and second set intersect at a right angle to create regions of discontinuity (e.g., 112, 112', and 112") that are generally diamond-shaped or square-shaped (i.e., as seen from the top view of FIG. 1) and are distributed across the surface 106. If desired, the spacing, width, or intersection angle of the coating strips may be varied to adjust the spacing, shapes, or sizes (i.e., largest linear dimension measured from the top view of FIG. 1) of the regions of discontinuity. Depending on the particular characteristics desired for the coated article 100 or method of applying the coating 104, the thickness of the coating strips may be generally uniform or may vary across a portion or portions of the coating 104. In the present embodiment, the thickness of the coating strips may be up to about 20 mm (e.g., from about 0.1 mm to about 20 mm), and, typically, the thickness of the coating strips may be up to about 2 mm (e.g., from about 0.1 mm to about 2 mm) to provide desired thermal regulating properties.

In the embodiment shown in FIG. 1 and FIG. 2, the regions of discontinuity are separated from one another and expose a remaining portion of the surface 106 that is not covered by the coating 104. Typically, the substrate 102 may have a higher level of softness, flexibility, air permeability, or water vapor transport properties than the coating 104 that covers the substrate 102. The regions of discontinuity may serve to provide improved flexibility by, for example, facilitating bending of the coated article 100 along a line that intersects one or more of the regions of discontinuity. By exposing the remaining portion of the surface 106, the regions of discontinuity may allow contact with the softer substrate 102 to provide an overall improvement in softness for the coated article 100. Alternatively or in conjunction, these regions of discontinuity may serve as passageways or openings to facilitate transport of air or water vapor through the coated article 100. In particular, the regions of discontinuity may facilitate transport of air or water vapor through the exposed portion of the surface 106.

It should be recognized that the coating 104 may, in general, be formed in a variety regular or irregular patterns and with regions of discontinuity having a variety of shapes and sizes. By way of example and not limitation, the coating 104 may be formed in a honeycomb pattern (e.g., with hexagonal regions of discontinuity), a grid pattern (e.g., with square-shaped or rectangular regions of discontinuity), a random pattern (e.g., with regions of discontinuity distributed randomly), and so forth. In general, the regions of discontinuity may be distributed across the surface 106 at intervals that are regularly spaced or not regularly spaced. The regions of discontinuity may be formed with a variety regular or irregular shapes such as, by way of example and not limitation, circular, half-circular, diamond-shaped, hexagonal, multilobal, octagonal, oval, pentagonal, rectangular, square-shaped, star-shaped, trapezoidal, triangular, wedge-shaped, and so forth. If desired, one or more regions of discontinuity may be shaped as logos, letters, or numbers. In the present embodiment, the regions of discontinuity may have sizes up to about 100 mm (e.g., from about 0.1 mm up to about 100 mm) and will typically have sizes ranging from about 1 mm to about 10 mm. In general, the regions of discontinuity may have the same or different shapes or sizes.

Figure 3:
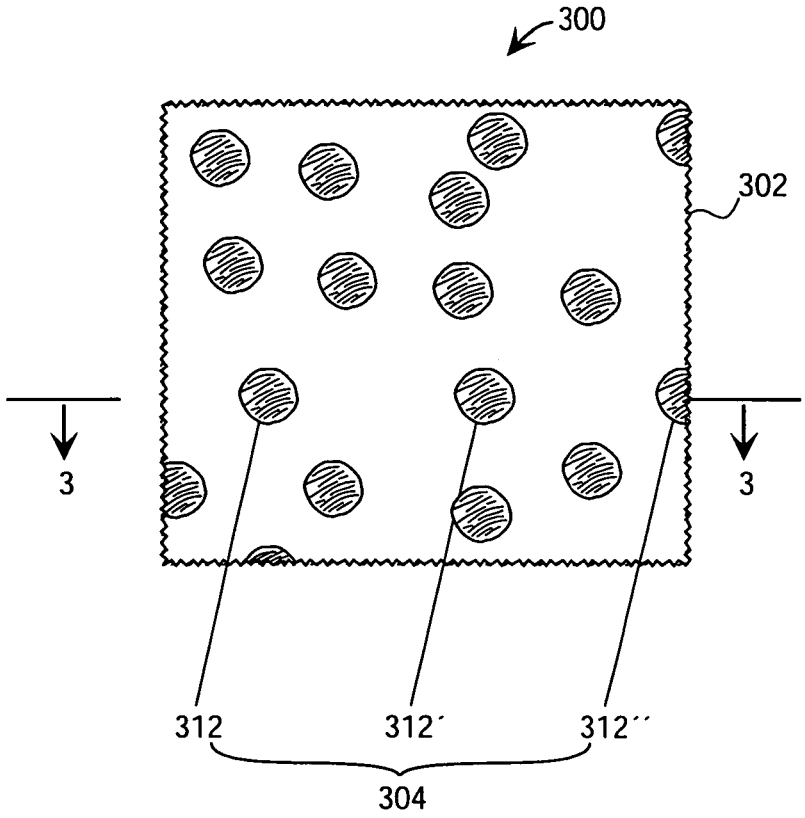
FIG. 3 illustrates a top sectional view of an exemplary coated article according to another embodiment of the invention.
Figure 4:
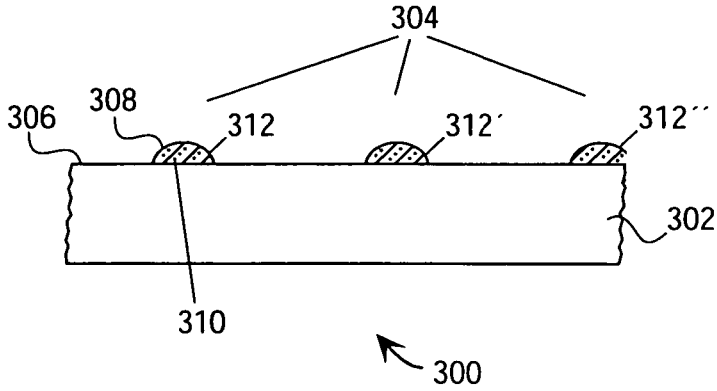
FIG. 4 illustrates a side sectional view of the exemplary coated article taken along line 3—3 of FIG. 3.

Turning next to FIG. 3 and FIG. 4, an exemplary coated article 300 in accordance with another embodiment of the invention is illustrated. In particular, FIG. 3 illustrates a top view of a section of the coated article 300, and FIG. 4 illustrates a side view of this section taken along line 3—3 of FIG. 3.

As with the coated article 100, the coated article 300 comprises a substrate 302 and a coating 304 covering at least a portion of the substrate 302. In particular, the coating 304 covers a portion of a surface 306 (e.g., a top surface) of the substrate 302. Depending on the particular characteristics of the substrate 302 or the coating 304 or method of forming the coated article 300, the coating 304 may extend below the surface 306 and permeate a portion of the substrate 302. While the coating 304 is shown covering one surface of the substrate 302, it should be recognized that the coating 304 may, alternatively or in conjunction, cover one or more different surfaces of the substrate 302 (e.g., a bottom or side surface). The coating 304 may be formed from a polymeric material 308 that has a temperature regulating material 310 dispersed therein, and the temperature regulating material 310 may be uniformly, or non-uniformly, dispersed within the coating 304. If desired, the coating 304 may comprise one or more additional temperature regulating materials that differ in some fashion from the temperature regulating material 310.

For the embodiment shown in FIG. 3 and FIG. 4, the coating 304 is formed in a dot pattern. In particular, the coating 304 is formed as a plurality of coating regions (e.g., 312, 312', and 312") that are generally circular (i.e., as seen from the top view of FIG. 3) and are distributed across the surface 306. In the present embodiment, the coating regions are distributed in a generally random manner across the surface 306. Depending on the particular characteristics desired for the coated article 300 or method of applying the coating 304, the thickness of a particular coating region (e.g., 312) may be uniform or non-uniform. As shown in FIG. 4, the coating regions of the present embodiment are formed as generally dome-like structures. If desired, the coating regions may be formed as cylindrical structures, pyramidal structures, cone-like structures, or various other regular or irregular structures. In the present embodiment, the thickness of a coating region (e.g., height of a dome-like structure shown in FIG. 4) may be up to about 20 mm (e.g., from about 0.1 mm to about 20 mm) and will typically be up to about 2 mm (e.g., from about 0.1 mm to about 2 mm). In general, the thickness of the coating regions may be the same or different.

As shown in FIG. 3 and FIG. 4, the coating regions are separated from one another and expose a remaining portion of the surface 306 that is not covered by the coating 304. Separation of the coating regions may serve to provide improved flexibility by, for example, facilitating bending of the coated article 300 or may allow contact with a softer substrate 302 to provide an overall improvement in softness for the coated article 300. Alternatively or in conjunction, separation of the coating regions may serve to facilitate transport of air or water vapor through the exposed portion of the surface 306.

Depending on the particular characteristics desired for the coated article 300 or method of applying the coating 304, the spacing, shapes, or sizes (i.e., largest linear dimension measured from the top view of FIG. 3) of the coating regions may be varied from that shown in FIG. 3 and FIG. 4. In general, the coating regions may be distributed across the surface 306 at intervals that are regularly spaced or not regularly spaced. For instance, instead of the random distribution shown in FIG. 3, the coating regions may be generally positioned at intersection points of an imaginary grid or any other two-dimensional network. The coating regions may be formed with a variety of regular or irregular shapes such as, by way of example and not limitation, circular, half-circular, diamond-shaped, hexagonal, multilobal, octagonal, oval, pentagonal, rectangular, square-shaped, star-shaped, triangular, trapezoidal, wedge-shaped, and so forth. If desired, one or more coating regions may be shaped as logos, letters, or numbers. In the present embodiment, the coating regions may have sizes up to about 10 mm (e.g., from about 0.1 mm up to about 10 mm) and will typically have sizes ranging from about 1 mm to about 4 mm. In general, the coating regions may have the same or different shapes or sizes.

It should be recognized that the coated articles 100 and 300 are discussed by way of example and not limitation, and various other embodiments are within the scope of the invention. For instance, a coated article according to some embodiments of the invention may comprise a coating formed with a plurality of shallow coating regions distributed throughout at least a portion of the coating. In particular, the shallow coating regions may be formed instead of, or in conjunction with, regions of discontinuity. For example, with reference to FIG. 1 and FIG. 2, the regions of discontinuity (e.g., 112, 112', and 112") may alternatively be formed as shallow coating regions that are generally diamond-shaped or square-shaped (i.e., as seen from the top view of FIG. 1). Typically, such shallow coating regions will be sufficiently thin to provide improved properties to the coated article. In particular, the shallow coating regions may facilitate bending of the coated article along a line that intersects one or more of the shallow coating regions. Alternatively or in conjunction, these shallow coating regions may serve as passageways to facilitate transport of air or water vapor through the coated article. In general, the thickness of the shallow coating regions may be up to about 50 percent of the thickness of a remaining elevated region of the coating (e.g., the coating strips shown in FIG. 1 and FIG. 2). Typically, the thickness of the shallow coating regions will be up to about 20 percent of the thickness of the remaining elevated region of the coating. As discussed in connection with the regions of discontinuity, the shallow coating regions may be distributed throughout the coating at intervals that are regularly spaced or not regularly spaced and may be formed with a variety of shapes and sizes.

As another example, a coated article according to other embodiments of the invention may comprise a coating that is formed with a plurality of elevated coating regions distributed throughout at least a portion of the coating. Typically, the elevated coating regions will serve to provide a higher loading level of a temperature regulating material and improved thermal regulating properties, while a remaining shallow region of the coating will be sufficiently thin to provide improved flexibility, softness, air permeability, or water vapor transport properties to the coated article. The thickness of the remaining shallow region of the coating may be up to about 50 percent of the thickness of the elevated coating regions and will typically be up to about 20 percent of the thickness of the elevated coating regions. The elevated coating regions may be distributed throughout the coating at intervals that are regularly spaced or not regularly spaced and may be formed with a variety of shapes and sizes.

According to some embodiments of the invention, a coating may cover from about 1 to about 100 percent (e.g., from about 1 to about 99 percent) of a surface of a substrate. In some presently preferred embodiments of the invention, the coating will cover from about 50 to about 90 percent (e.g., from about 50 to about 80 percent) of the surface. By way of example and not limitation, when thermal regulating properties of a coated article are a controlling consideration, the coating may cover a larger percentage of the surface. On the other hand, when other properties of the coated article (e.g., flexibility, softness, air permeability, or water vapor transport properties) are a controlling consideration, the coating may cover a smaller percentage of the surface. Alternatively or in conjunction, when balancing thermal regulating and other properties of the coated article, it may be desirable to adjust the thickness of the coating (e.g., thickness of the coating strips shown in FIG. 1 and FIG. 2) or a loading level of a temperature regulating material dispersed within the coating.

It may be preferred, but not required, that the coating is formed such as to provide generally uniform properties (e.g., thermal regulating properties, flexibility, softness, air permeability, or water vapor transport properties) across the surface of the substrate. Such uniformity in properties may provide greater consistency or reproducibility for products made from the coated article (e.g., products made from different sections of the coated article). For clothing applications, for example, uniformity in properties across the surface may also provide a greater level of comfort for an individual during end use. For instance, uniformity in thermal regulating properties may serve to inhibit heat from being preferentially and undesirably conducted across a section of the coated article that may contain a lesser amount of the temperature regulating material than another section. Accordingly, development of hot or cold spots may be reduced or prevented. Uniformity in flexibility or softness may provide a more even "feel" to the coated article, while uniformity in air permeability or water vapor transport properties may reduce or prevent development of hot or wet spots during end use.

According to some embodiments of the invention, uniformity in properties may be provided by having regions of discontinuity (e.g., 112, 112', and 112") or coating regions (e.g., 312, 312', and 312") distributed in a substantially uniform manner across at least a portion of the surface of the substrate. For such embodiments of the invention, it may also be desired, but not required, that the thickness of the coating (e.g., thickness of the coating strips shown in FIG. 1 and FIG. 2) is substantially uniform across the surface. Distribution of the regions of discontinuity (or the coating regions) across the surface may be measured using variability of the coating from one section of the coated article to another. According to some embodiments of the invention, a greater uniformity in distribution of these regions will correspond to a smaller variability of the coating from one section of the coated article to another. Useful measures of the distribution of these regions include, by way of example and not limitation, variability in number of regions of discontinuity (or coating regions) located in different sections, variability in surface coverage percent provided by the coating for different sections, or variability in weight of the coating for different sections. For some embodiments of the invention, the regions may be distributed substantially uniformly across the surface if one or more of these measures vary, on average, less than 20 percent from one section to another (e.g., a standard deviation of less than 20 percent). For instance, the number of regions of discontinuity (or coating regions) located in different 1 $m^2$ sections of the coated article may vary, on average, less than 20 percent, the surface coverage percent provided by the coating for different 1 $m^2$ sections may vary, on average, less than 20 percent, or the weight of the coating covering different 1 $m^2$ sections may vary, on average, less than 20 percent. It may be preferred, but not required, that one or more of these measures vary, on average, less than 10 percent from one section to another. If desired, a different area for a section (i.e., a different unit of area) may be used when calculating one or more of these measures. In particular, a different unit of area may be used depending upon the total surface area of the coated article. Also, a smaller unit of area (e.g., 1 $dm^2$ or 1 $cm^2$) may be selected if uniformity is desired at a smaller scale. For instance, to provide consistency in products made from the coated article, a smaller unit of area may be selected if the coated article will be segmented to make smaller products (e.g., gloves) rather than larger products (e.g., jackets).

It should be recognized that the regions of discontinuity (or the coating regions) need not be uniformly distributed for all applications of the coated article. Thus, the distribution of these regions may be varied within one or more sections of the coated article. For instance, these regions may be concentrated within one or more sections of the coated article or distributed in accordance with a concentration profile along one or more directions across the surface.

As discussed previously, a coated article in accordance with various embodiments of the invention may comprise a coating that covers at least a portion of a substrate. For some embodiments of the invention, the coating may be formed from a polymeric material that has a temperature regulating material dispersed therein. According to other embodiments of the invention, the coating may be formed from a temperature regulating material that need not be dispersed within a polymeric material. The coating according to some embodiments of the invention may comprise up to about 100 percent by weight of the temperature regulating material (e.g., up to about 90 percent, up to about 50 percent, or up to about 25 percent by weight of the temperature regulating material). Typically, the temperature regulating material will comprise one or more phase change materials to provide the coated article with enhanced reversible thermal properties.

In general, a phase change material may comprise any substance (or mixture of substances) that has the capability of absorbing or releasing thermal energy to reduce or eliminate heat flow at or within a temperature stabilizing range. The temperature stabilizing range may comprise a particular transition temperature or range of transition temperatures. A phase change material used in conjunction with various embodiments of the invention preferably will be capable of inhibiting a flow of thermal energy during a time when the phase change material is absorbing or releasing heat, typically as the phase change material undergoes a transition between two states (e.g., liquid and solid states, liquid and gaseous states, solid and gaseous states, or two solid states). This action is typically transient, e.g., will occur until a latent heat of the phase change material is absorbed or released during a heating or cooling process. Thermal energy may be stored or removed from the phase change material, and the phase change material typically can be effectively recharged by a source of heat or cold. By selecting an appropriate phase change material, the coated article may be designed for use in any one of numerous products.

According to some embodiments of the invention, a phase change material may be a solid/solid phase change material. A solid/solid phase change material is a type of phase change material that typically undergoes a transition between two solid states (e.g., a crystalline or mesocrystalline phase transformation) and hence typically does not become a liquid during use.

Phase change materials that can be incorporated in the coated article in accordance with various embodiments of the invention include a variety of organic and inorganic substances. Exemplary phase change materials include, by way of example and not by limitation, hydrocarbons (e.g., straight chain alkanes or paraffinic hydrocarbons, branched-chain alkanes, unsaturated hydrocarbons, halogenated hydrocarbons, and alicyclic hydrocarbons), hydrated salts (e.g., calcium chloride hexahydrate, calcium bromide hexahydrate, magnesium nitrate hexahydrate, lithium nitrate trihydrate, potassium fluoride tetrahydrate, ammonium alum, magnesium chloride hexahydrate, sodium carbonate decahydrate, disodium phosphate dodecahydrate, sodium sulfate decahydrate, and sodium acetate trihydrate), waxes, oils, water, fatty acids, fatty acid esters, dibasic acids, dibasic esters, 1-halides, primary alcohols, aromatic compounds, clathrates, semi-clathrates, gas clathrates, anhydrides (e.g., stearic anhydride), ethylene carbonate, polyhydric alcohols (e.g., 2,2-dimethyl-1,3-propanediol, 2-hydroxymethyl-2-methyl-1,3-propanediol, ethylene glycol, polyethylene glycol, pentaerythritol, dipentaerythritol, pentaglycerine, tetramethylol ethane, neopentyl glycol, tetramethylol propane, 2-amino-2-methyl-1,3-propanediol, monoaminopentaerythritol, diaminopentaerythritol, and tris (hydroxymethyl)acetic acid), polymers (e.g., polyethylene, polyethylene glycol, polyethylene oxide, polypropylene, polypropylene glycol, polytetramethylene glycol, polypropylene malonate, polyneopentyl glycol sebacate, polypentane glutarate, polyvinyl myristate, polyvinyl stearate, polyvinyl laurate, polyhexadecyl methacrylate, polyoctadecyl methacrylate, polyesters produced by polycondensation of glycols (or their derivatives) with diacids (or their derivatives), and copolymers, such as polyacrylate or poly(meth) acrylate with alkyl hydrocarbon side chain or with polyethylene glycol side chain and copolymers comprising polyethylene, polyethylene glycol, polyethylene oxide, polypropylene, polypropylene glycol, or polytetramethylene glycol), metals, and mixtures thereof.

The selection of a phase change material will typically be dependent upon a desired transition temperature or a desired application of the coated article. For example, a phase change material having a transition temperature near room temperature may be desirable for applications in which the coated article is incorporated into apparel designed to maintain a comfortable temperature for a user. A phase change material according to some embodiments of the invention may have a transition temperature ranging from about −5° to about 125° C. In one presently preferred embodiment useful for clothing applications, the phase change material will have a transition temperature ranging from about 22° to about 40° C. or from about 22° to about 28° C.

Particularly useful phase change materials include paraffinic hydrocarbons having between 10 to 44 carbon atoms (i.e., $C_{10}$–$C_{44}$ paraffinic hydrocarbons). Table 1 provides a list of exemplary $C_{13}$–$C_{28}$ paraffinic hydrocarbons that may be used as the phase change material in the coated articles described herein. The number of carbon atoms of a paraffinic hydrocarbon typically correlates with its melting point. For example, n-Octacosane, which contains twenty-eight straight chain carbon atoms per molecule, has a melting point of 61.4° C. By comparison, n-Tridecane, which contains thirteen straight chain carbon atoms per molecule, has a melting point of −5.5° C. According to an embodiment of the invention, n-Octadecane, which contains eighteen straight chain carbon atoms per molecule and has a melting point of 28.2° C., is particularly desirable for clothing applications.

TABLE 1

| Paraffinic Hydrocarbon | No. of Carbon Atoms | Melting Point (° C.) |
|---|---|---|
| n-Octacosane | 28 | 61.4 |
| n-Heptacosane | 27 | 59.0 |
| n-Hexacosane | 26 | 56.4 |
| n-Pentacosane | 25 | 53.7 |
| n-Tetracosane | 24 | 50.9 |
| n-Tricosane | 23 | 47.6 |
| n-Docosane | 22 | 44.4 |
| n-Heneicosane | 21 | 40.5 |
| n-Eicosane | 20 | 36.8 |
| n-Nonadecane | 19 | 32.1 |
| n-Octadecane | 18 | 28.2 |
| n-Heptadecane | 17 | 22.0 |
| n-Hexadecane | 16 | 18.2 |
| n-Pentadecane | 15 | 10.0 |
| n-Tetradecane | 14 | 5.9 |
| n-Tridecane | 13 | −5.5 |

Other useful phase change materials include polymeric phase change materials having transition temperatures suitable for a desired application of the coated article (e.g., from about 22° to about 40° C. for clothing applications). A polymeric phase change material may comprise a polymer (or mixture of polymers) having a variety of chain structures that include one or more types of monomer units. In particular, polymeric phase change materials may include linear polymers, branched polymers (e.g., star branched polymers, comb branched polymers, or dendritic branched polymers), or mixtures thereof. A polymeric phase change material may comprise a homopolymer, a copolymer (e.g., terpolymer, statistical copolymer, random copolymer, alternating copolymer, periodic copolymer, block copolymer, radial copolymer, or graft copolymer), or a mixture thereof. As one of ordinary skill in the art will understand, the reactivity and functionality of a polymer may be altered by addition of a functional group such as, for example, amine, amide, carboxyl, hydroxyl, ester, ether, epoxide, anhydride, isocyanate, silane, ketone, aldehyde, or unsaturated group. Also, a polymer comprising a polymeric phase change material may be capable of crosslinking, entanglement, or hydrogen bonding in order to increase its toughness or its resistance to heat, moisture, or chemicals.

According to some embodiments of the invention, a polymeric phase change material may be desirable as a result of having a higher molecular weight, larger molecular size, or higher viscosity relative to non-polymeric phase change materials (e.g., paraffinic hydrocarbons). As a result of this larger molecular size or higher viscosity, a polymeric phase change material may exhibit a lesser tendency to leak from the coating during processing or during end use. In addition to providing thermal regulating properties, a polymeric phase change material may provide improved mechanical properties (e.g., ductility, tensile strength, and hardness) when incorporated in the coating. According to some embodiments of the invention, the polymeric phase change material may be used to form the coating without requiring the polymeric material, thus allowing for a higher loading level of the polymeric phase change material and improved thermal regulating properties. Since the polymeric material is not required, use of the polymeric phase change material may allow for a thinner coating and improved flexibility, softness, air permeability, or water vapor transport properties for the coated article.

For example, polyethylene glycols may be used as the phase change material in some embodiments of the invention. The number average molecular weight of a polyethylene glycol typically correlates with its melting point. For instance, a polyethylene glycol having a number average molecular weight range of 570 to 630 (e.g., Carbowax 600) will have a melting point of 20° to 25° C., sirable for clothing applications. Other polyethylene glycols that may be useful at other temperature stabilizing ranges include Carbowax 400 (melting point of 4° to 8° C.), Carbowax 1500 (melting point of 44° to 48° C.), and Carbowax 6000 (melting point of 56° to 63° C.). Polyethylene oxides having a melting point in the range of 60° to 65° C. may also be used as phase change materials in some embodiments of the invention. Further desirable phase change materials include polyesters having a melting point in the range of 0° to 40° C. that may be formed, for example, by polycondensation of glycols (or their derivatives) with diacids (or their derivatives). Table 2 sets forth melting points of exemplary polyesters that may be formed with various combinations of glycols and diacids.

TABLE 2

| Glycol | Diacid | Melting Point of Polyester (° C.) |
|---|---|---|
| Ethylene glycol | Carbonic | 39 |
| Ethylene glycol | Pimelic | 25 |
| Ethylene glycol | Diglycolic | 17–20 |
| Ethylene glycol | Thiodivaleric | 25–28 |
| 1,2-Propylene glycol | Diglycolic | 17 |
| Propylene glycol | Malonic | 33 |
| Propylene glycol | Glutaric | 35–39 |
| Propylene glycol | Diglycolic | 29–32 |
| Propylene glycol | Pimelic | 37 |
| 1,3-butanediol | Sulphenyl divaleric | 32 |
| 1,3-butanediol | Diphenic | 36 |
| 1,3-butanediol | Diphenyl methane-m,m'-diacid | 38 |
| 1,3-butanediol | trans-H,H-terephthalic acid | 18 |
| Butanediol | Glutaric | 36–38 |
| Butanediol | Pimelic | 38–41 |
| Butanediol | Azelaic | 37–39 |
| Butanediol | Thiodivaleric | 37 |
| Butanediol | Phthalic | 17 |
| Butanediol | Diphenic | 34 |
| Neopentyl glycol | Adipic | 37 |
| Neopentyl glycol | Suberic | 17 |
| Neopentyl glycol | Sebacic | 26 |
| Pentanediol | Succinic | 32 |
| Pentanediol | Glutaric | 22 |
| Pentanediol | Adipic | 36 |
| Pentanediol | Pimelic | 39 |
| Pentanediol | para-phenyl diacetic acid | 33 |
| Pentanediol | Diglycolic | 33 |
| Hexanediol | Glutaric | 28–34 |
| Hexanediol | 4-Octenedioate | 20 |
| Heptanediol | Oxalic | 31 |
| Octanediol | 4-Octenedioate | 39 |
| Nonanediol | meta-phenylene diglycolic | 35 |
| Decanediol | Malonic | 29–34 |
| Decanediol | Isophthalic | 34–36 |
| Decanediol | meso-tartaric | 33 |
| Diethylene glycol | Oxalic | 10 |
| Diethylene glycol | Suberic | 28–35 |
| Diethylene glycol | Sebacic | 36–44 |
| Diethylene glycol | Phthalic | 11 |
| Diethylene glycol | trans-H,H-terephthalic acid | 25 |
| Triethylene glycol | Sebacic | 28 |
| Triethylene glycol | Sulphonyl divaleric | 24 |
| Triethylene glycol | Phthalic | 10 |
| Triethylene glycol | Diphenic | 38 |
| para-dihydroxy-methyl benzene | Malonic | 36 |

TABLE 2-continued

| Glycol | Diacid | Melting Point of Polyester (° C.) |
|---|---|---|
| meta-dihydroxy-methyl benzene | Sebacic | 27 |
| meta-dihydroxy-methyl benzene | Diglycolic | 35 |

According to some embodiments of the invention, a polymeric phase change material having a desired transition temperature may be formed by reacting a phase change material (e.g., an exemplary phase change material discussed above) with a polymer (or mixture of polymers). Thus, for example, n-octadecylic acid (i.e., stearic acid) may be reacted or esterified with polyvinyl alcohol to yield polyvinyl stearate, or dodecanoic acid (i.e., lauric acid) may be reacted or esterified with polyvinyl alcohol to yield polyvinyl laurate. Various combinations of phase change materials (e.g., phase change materials with one or more functional groups such as amine, carboxyl, hydroxyl, epoxy, silane, sulfuric, and so forth) and polymers may be reacted to yield polymeric phase change materials having desired transition temperatures.

A phase change material can comprise a mixture of two or more substances (e.g., two or more of the exemplary phase change materials discussed above). By selecting two or more different substances (e.g., two different paraffinic hydrocarbons) and forming a mixture thereof, a temperature stabilizing range can be adjusted over a wide range for any particular application of the coated article. According to some embodiments of invention, the mixture of two or more different substances may exhibit two or more distinct transition temperatures or a single modified transition temperature.

According to some embodiments of the invention, the temperature regulating material may comprise a containment structure that encapsulates, contains, surrounds, absorbs, or reacts with a phase change material. This containment structure may facilitate handling of the phase change material while offering a degree of protection to the phase change material during manufacture of the coated article or a product made therefrom. Moreover, the containment structure may serve to prevent leakage of the phase change material from the coated article during end use.

For instance, the temperature regulating material may comprise a plurality of microcapsules that contain a phase change material, and the microcapsules may be uniformly, or non-uniformly, dispersed within the coating. The microcapsules may be formed shells enclosing the phase change material and may be formed in a variety regular or irregular shapes (e.g., spherical, ellipsoidal, and so forth) and sizes. The microcapsules may have the same or different shapes or sizes. According to some embodiments of the invention, the microcapsules may have a size (e.g., diameter) ranging from about 0.01 to about 100 microns. In one presently preferred embodiment, the microcapsules will have a generally spherical shape and will have a size (e.g., diameter) ranging from about 0.5 to about 3 microns. Other examples of the containment structure may include, by way of example and not by limitation, silica particles (e.g., precipitated silica particles, fumed silica particles, and mixtures thereof), zeolite particles, carbon particles (e.g., graphite particles, activated carbon particles, and mixtures thereof), and absorbent materials (e.g., absorbent polymeric materials, superabsorbent materials, cellulosic materials, poly(meth)acrylate materials, metal salts of poly(meth)acrylate materials, and mixtures thereof). For instance, the temperature regulating material may comprise silica particles, zeolite particles, carbon particles, or an absorbent material impregnated with a phase change material.

According to other embodiments of the invention, the temperature regulating material may comprise a phase change material in a raw form (e.g., the phase change material is non-encapsulated, i.e., not micro- or macroencapsulated). During manufacture of the coated article, the phase change material in the raw form may be provided as a solid in a variety of forms (e.g., bulk form, powders, pellets, granules, flakes, and so forth ) or as a liquid in a variety of forms (e.g., molten form, dissolved in a solvent, and so forth ). To reduce or prevent leakage of the phase change material, it may be desirable, but not required, that a phase change material used in a raw form is a solid/solid phase change material.

In general, the polymeric material may comprise any polymer (or mixture of polymers) that has the capability of being formed into the coating. According to some embodiments of the invention, the polymeric material may provide a matrix within which the temperature regulating material may be dispersed and may serve to bind the temperature regulating material to the substrate. The polymeric material may offer a degree of protection to the temperature regulating material during manufacture of the coated article or a product made therefrom or during end use. According to some embodiments of the invention, the polymeric material may comprise a thermoplastic polymer (or mixture of thermoplastic polymers) or a thermoset polymer (or mixture of thermoset polymers).

The polymeric material may comprise a polymer (or mixture of polymers) having a variety of chain structures that include one or more types of monomer units. In particular, the polymeric material may comprise a linear polymer, a branched polymer (e.g., star branched polymer, comb branched polymer, or dendritic branched polymer), or a mixture thereof. The polymeric material may comprise a homopolymer, a copolymer (e.g., terpolymer, statistical copolymer, random copolymer, alternating copolymer, periodic copolymer, block copolymer, radial copolymer, or graft copolymer), or a mixture thereof. As discussed previously, the reactivity and functionality of a polymer may be altered by addition of a functional group such as, for example, amine, amide, carboxyl, hydroxyl, ester, ether, epoxide, anhydride, isocyanate, silane, ketone, aldehyde, or unsaturated group. Also, a polymer comprising the polymeric material may be capable of crosslinking, entanglement, or hydrogen bonding in order to increase its toughness or its resistance to heat, moisture, or chemicals.

Exemplary polymeric materials that may be used to form the coating include, by way of example and not by limitation, polyamides, polyamines, polyimides, polyacrylics (e.g., polyacrylamide, polyacrylonitrile, esters of methacrylic acid and acrylic acid, and so forth), polycarbonates (e.g., polybisphenol A carbonate, polypropylene carbonate, and so forth), polydienes (e.g., polybutadiene, polyisoprene, polynorbomene, and so forth), polyepoxides, polyesters (e.g., polycaprolactone, polyethylene adipate, polybutylene adipate, polypropylene succinate, polyesters based on terephthalic acid, polyesters based on phthalic acid, and so forth), polyethers (e.g., polyethylene glycol (polyethylene oxide), polybutylene glycol, polypropylene oxide, polyoxymethylene (paraformaldehyde), polytetramethylene ether (polytetrahydrofuran), polyepichlorohydrin, and so forth), polyfluorocarbons, formaldehyde polymers (e.g., urea-formaldehyde, melamine-formaldehyde, phenol formaldehyde, and so forth), natural polymers (e.g., cellulosics, chitosans, lignins, waxes, and so forth), polyolefins (e.g., polyethylene, polypropylene, polybutylene, polybutene, polyoctene, and so forth), polyphenylenes, silicon containing polymers (e.g., polydimethyl siloxane, polycarbomethyl silane, and so forth), polyurethanes, polyvinyls (e.g., polyvinyl butyral, polyvinyl alcohol, esters and ethers of polyvinyl alcohol, polyvinyl acetate, polystyrene, polymethylstyrene, polyvinyl chloride, polyvinyl pryrrolidone, polymethyl vinyl ether, polyethyl vinyl ether, polyvinyl methyl ketone, and so forth), polyacetals, polyarylates, alkyd based polymers (i.e., polymers based on glyceride oil), and copolymers (e.g., polyethylene-co-vinyl acetate, polyethylene-co-acrylic acid, and so forth).

For certain applications of the coated article, the polymeric material may comprise a polymer (or mixture of polymers) that facilitates dispersing or incorporating the temperature regulating material within the coating. For instance, the polymeric material may comprise a polymer (or mixture of polymers) that is compatible or miscible with or has an affinity for the temperature regulating material. In some embodiments of the invention, this affinity may depend on, by way of example and not by limitation, similarity of solubility parameters, polarities, hydrophobic characteristics, or hydrophilic characteristics of the polymeric material and the temperature regulating material. Such affinity may facilitate incorporation of a more uniform or higher loading level of the temperature regulating material in the coating. In addition, a smaller amount of the polymeric material may be needed to incorporate a desired loading level of the temperature regulating material, thus allowing for a thinner coating and improved flexibility, softness, air permeability, or water vapor transport properties for the coated article. In embodiments where the temperature regulating material comprises a containment structure that contains a phase change material, the polymeric material may comprise a polymer (or mixture of polymers) selected for its affinity for the containment structure in conjunction with or as an alternative to its affinity for the phase change material. For instance, if the temperature regulating material comprises a plurality of microcapsules containing the phase change material, a polymer (or mixture of polymers) may be selected having an affinity for the microcapsules (e.g., for a material or materials of which the microcapsules are formed). For instance, some embodiments of the invention may select the polymeric material to comprise the same or a similar polymer as a polymer comprising the microcapsules. In some presently preferred embodiments of the invention, the polymeric material may be selected to be sufficiently non-reactive with the temperature regulating material so that a desired temperature stabilizing range is maintained.

Depending upon the particular application of the coated article, the coating may further comprise one or more additives, such as, by way of example and not limitation, water, surfactants, dispersants, anti-foam agents (e.g., silicone containing compounds and fluorine containing compounds), thickeners (e.g., polyacrylic acid, cellulose esters and their derivatives, and polyvinyl alcohols), foam stabilizers (e.g., inorganic salts of fatty acids or their sulfate partial esters and anionic surfactants), antioxidants (e.g., hindered phenols and phosphites), thermal stabilizers (e.g., phosphites, organophosphorous compounds, metal salts of organic carboxylic acids, and phenolic compounds), light or UV stabilizers (e.g., hydroxy benzoates, hindered hydroxy benzoates, and hindered amines), microwave absorbing additives (e.g., multifunctional primary alcohols, glycerine, and carbon), reinforcing fibers (e.g., carbon fibers, aramid fibers, and glass fibers), conductive fibers or particles (e.g., graphite or activated carbon fibers or particles), lubricants, process aids (e.g., metal salts of fatty acids, fatty acid esters, fatty acid ethers, fatty acid amides, sulfonamides, polysiloxanes, organophosphorous compounds, silicon containing compounds, fluorine containing compounds, and phenolic polyethers), fire retardants (e.g., halogenated compounds, phosphorous compounds, organophosphates, organobromides, alumina trihydrate, melamine derivatives, magnesium hydroxide, antimony compounds, antimony oxide, and boron compounds), anti-blocking additives (e.g., silica, talc, zeolites, metal carbonates, and organic polymers), anti-fogging additives (e.g., non-ionic surfactants, glycerol esters, polyglycerol esters, sorbitan esters and their ethoxylates, nonyl phenyl ethoxylates, and alcohol ethyoxylates), anti-static additives (e.g., non-ionics such as fatty acid esters, ethoxylated alkylamines, diethanolamides, and ethoxylated alcohol; anionics such as alkylsulfonates and alkylphosphates; cationics such as metal salts of chlorides, methosulfates or nitrates, and quaternary ammonium compounds; and amphoterics such as alkylbetaines), anti-microbials (e.g., arsenic compounds, sulfur, copper compounds, isothiazolins phthalamides, carbamates, silver base inorganic agents, silver zinc zeolites, silver copper zeolites, silver zeolites, metal oxides, and silicates), crosslinkers or controlled degradation agents (e.g., peroxides, azo compounds, and silanes), colorants, pigments, dyes, fluorescent whitening agents or optical brighteners (e.g., bis-benzoxazoles, phenylcoumarins, and bis-(styryl)biphenyls), fillers (e.g., natural minerals and metals such as oxides, hydroxides, carbonates, sulfates, and silicates; talc; clay; wollastonite; graphite; carbon black; carbon fibers; glass fibers and beads; ceramic fibers and beads; metal fibers and beads; flours; and fibers of natural or synthetic origin such as fibers of wood, starch, or cellulose flours), coupling agents (e.g., silanes, titanates, zirconates, fatty acid salts, anhydrides, epoxies, and unsaturated polymeric acids), reinforcement agents, crystallization or nucleation agents (e.g., any material which increases or improves the crystallinity in a polymer, such as to improve rate/kinetics of crystal growth, number of crystals grown, or type of crystals grown), and so forth. The one or more additives may be dispersed uniformly, or non-uniformly, within the coating. Typically, the one or more additives will be selected to be sufficiently non-reactive with the temperature regulating material so that a desired temperature stabilizing range is maintained.

According to some embodiments of the invention, certain treatments or additional coatings may be applied to the coated article to impart properties such as, by way of example and not limitation, stain resistance, water repellency, softer feel, and moisture management properties. Exemplary treatments and coatings include Epic by Nextec Applications Inc., Intera by Intera Technologies, Inc., Zonyl Fabric Protectors by DuPont Inc., Scotchgard by 3M Co., and so forth.

A coated article in accordance with various embodiments of the invention may be manufactured using a variety of methods. According to some embodiments of the invention, one or more temperature regulating materials may be mixed with a polymeric material to form a blend. For some embodiments of the invention, a temperature regulating material may comprise microcapsules containing one or more phase change materials. If desired, the microcapsules may be wetted with water to facilitate their handling. The polymeric material may be provided as a liquid in a variety of forms (e.g., molten form, emulsion form, dissolved in water or an organic solvent, and so forth). According to some embodiments of the invention, monomer units or low molecular weight polymers may be initially provided, which, upon curing, drying, crosslinking, reacting, or solidifying, are converted to a polymeric material having a desired molecular weight or chain structure.

As discussed previously, one or more additives may be added when forming the blend. For instance, a surfactant may be added to decrease interfacial surface tension and promote wetting of the temperature regulating material, or a dispersant may be added to promote uniform dispersion or incorporation of a higher loading level of the temperature regulating material in the blend. If desired, a thickener may be added to adjust the viscosity of blend to reduce or prevent the temperature regulating material from sinking, or an anti-foam agent may be added to remove trapped air bubbles formed during mixing.

By way of example and not limitation, the blend may be formed as described in the patent of Zuckerman, et al., entitled "Fabric Coating Composition Containing Energy Absorbing Phase Change Material", U.S. Pat. No. 6,207,738, issued Mar. 27, 2001, and in the published PCT patent application of Zuckerman, et al., entitled "Energy Absorbing Fabric Coating and Manufacturing Method", International Publication No. WO 95/34609, published Dec. 21, 1995, the disclosure of which are incorporated herein by reference in their entirety.

According to some embodiments of the invention, the blend may be foamed using a variety of methods, such as, by way of example and not limitation, mechanical foaming or chemical foaming. For example, the blend may be pumped through an Oakes mixer or other mechanical foamer that injects air into the blend. For such embodiments of the invention, it may be desired, but not required, that a foam stabilizer be added to the blend. Foaming the blend may result in a coating (e.g., a foamed coating) that provides improved flexibility, softness, air permeability, or water vapor transport properties to the coated article.

Once formed, the blend may be applied to or deposited on one or more surfaces of a substrate using a variety coating processes, such as, by way of example and not limitation, roll coating (e.g., direct gravure coating, reverse gravure coating, differential offset gravure coating, or reverse roll coating), screen coating, spray coating (e.g., air atomized spraying, airless atomized spraying, or electrostatic spraying), extrusion coating, and so forth. For instance, in a roll coating process, the substrate may be passed between a pair of rolls, and at least one of these rolls typically is an applicator roll that applies the blend to the substrate. In particular, the applicator roll may be engraved or etched with cells that apply the blend to the substrate in a regular or irregular pattern. Alternatively or in conjunction, a third engraved roll may apply the blend to the substrate through a smooth applicator roll. In a screen coating process, a rotary screen (e.g., a rotating screen cylinder) may be used to apply the blend to the substrate. In particular, the blend may be spread on an inner wall of the rotary screen and applied to the substrate in regular or irregular pattern through screen holes formed in the rotary screen. In a spray coating process, the blend may be sprayed onto the substrate in a regular or irregular pattern. In an extrusion coating process, the blend may be extruded to form a film or sheet having a regular or irregular pattern, and this film or sheet may then be attached or bonded to the substrate using a variety of methods.

It should be recognized that transfer coating techniques may be used with the various coating processes described above. In particular, the blend may be first applied to a carrier sheet and then transferred from the carrier sheet to the substrate. According to some embodiments of the invention, the blend may be applied to the substrate to form a continuous coating covering the substrate, and one or more portions of this continuous coating may be removed using a variety of chemical, mechanical, thermal, or electromagnetic methods to result in a coating formed in a regular or irregular pattern. By way of example and not limitation, the continuous coating may be perforated using needles to form small diameter holes as described in the co-pending and co-owned patent application of Worley, entitled "Micro-perforated Temperature Regulating Fabrics, Garments and Articles Having Improved Softness, Flexibility, Breathability and Moisture Vapor Transport Properties", U.S. Ser. No. 09/851,306, filed May 8, 2001, the disclosure of which is incorporated herein by reference in its entirety.

After the blend has been applied to the substrate, the blend may be cured, dried, crosslinked, reacted, or solidified to form a coating covering the substrate. The resulting coated article may then be further processed to form a variety of products having enhanced reversible thermal properties.

It should be recognized that the polymeric material need not be used for certain applications of the coated article. For instance, the temperature regulating material may comprise a polymeric phase change material having a desired transition temperature, and this polymeric phase change material may be used to form the coating without requiring the polymeric material. The polymeric phase change material may be provided as a liquid in a variety of forms (e.g., molten form, emulsion form, dissolved in water or an organic solvent, and so forth). According to some embodiments of the invention, monomer units or low molecular weight polymers may be initially provided, which, upon curing, drying, crosslinking, reacting, or solidifying, are converted to the polymeric phase change material having a desired molecular weight or chain structure. If desired, one or more additives may be added to the polymeric phase change material to form a blend. The polymeric phase change material may be applied to or deposited on one or more surfaces of the substrate using a variety coating processes as described above and then cured, dried, crosslinked, reacted, or solidified to form a coating covering the substrate.

EXAMPLES

The following examples describe specific aspects of the invention to illustrate and provide a description of the invention for those of ordinary skill in the art. The examples should not be construed as limiting the invention, as the examples merely provide specific methodology useful in understanding and practicing the invention.

Example 1

A water-based acrylic resin coating blend (65 percent of dry weight of microcapsules containing a phase change material based on total dry weight of solids, supplied as BR-5152 by Basic Adhesives Inc., Carlstadt, N.J.) was adjusted for viscosity and applied to a substrate using a rotary screen. The rotary screen (manufactured by vanVeen-Bell, Easton, Pa.) was a 30 mesh metal screen with screen pattern #0T03 produced on it. This pattern provided 75 percent surface coverage with a circular dot pattern. The substrate used was a 140 g/m$^2$ 100% polyester micro fleece lining (Vendor Style: A001606, supplied by Ching-Mei Textile Corp., Taiwan). The coating blend was applied to the substrate at 200 g/m$^2$ and then dried in a forced air oven for 10 minutes at 130° C. to yield a flexible, air permeable coating with a circular dot pattern. The final weight of the coating was 100 g/m$^2$, which yielded 65 g/m$^2$ of the microcapsules containing the phase change material.

Example 2

A water-based acrylic resin coating blend (65 percent of dry weight of microcapsules containing a phase change material based on total dry weight of solids, supplied as BR-5152 by Basic Adhesives Inc., Carlstadt, N.J.) was adjusted for viscosity and applied to a substrate using a rotary screen. The rotary screen (manufactured by vanVeen-Bell, Easton, Pa.) was a 30 mesh metal screen with screen pattern #0T03 produced on it. This pattern provided 75 percent surface coverage with a circular dot pattern. The substrate used was a 150 g/m$^2$ 100% polyester apertured non-woven fabric (supplied by Tiong Liong Corp., Taiwan). The coating blend was applied to the substrate at 230 g/m$^2$ and then dried in a forced air oven for 10 minutes at 130° C. to yield a flexible, air permeable coating with a circular dot pattern. The final weight of the coating was 115 g/m$^2$, which yielded 75 g/m$^2$ of the microcapsules containing the phase change material.

Each of the patent applications, patents, publications, and other published documents mentioned or referred to in this specification is herein incorporated by reference in its entirety, to the same extent as if each individual patent application, patent, publication, and other published document was specifically and individually indicated to be incorporated by reference.

While the present invention has been described with reference to the specific embodiments thereof, it should be understood by those skilled in the art that various changes may be made and equivalents may be substituted without departing from the true spirit and scope of the invention as defined by the appended claims. In addition, many modifications may be made to adapt a particular situation, material, composition of matter, method, process step or steps, to the objective, spirit and scope of the present invention. All such modifications are intended to be within the scope of the claims appended hereto. In particular, while the methods disclosed herein have been described with reference to particular steps performed in a particular order, it will be understood that these steps may be combined, sub-divided, or re-ordered to form an equivalent method without departing from the teachings of the present invention. Accordingly, unless specifically indicated herein, the order and grouping of the steps is not a limitation of the present invention.

What is claimed is:

1. A coated article having enhanced reversible thermal properties, comprising:

a substrate having a surface; and a coating covering a portion of the surface and comprising a polymeric material and a non-encapsulated phase change material dispersed in the polymeric material, wherein the non-encapsulated phase change material is a solid/solid phase change material, and the coating is formed as a plurality of coating regions that are distributed substantially uniformly across the surface and are separated from one another to provide improved flexibility and air permeability to the coated article.

2. The coated article of claim 1, wherein the substrate is a fabric, film, foam, or leather.

3. The coated article of claim 1, wherein the non-encapsulated phase change material has a transition temperature in the range of 22° to 40° C.

4. The coated article of claim 3, wherein the transition temperature of the non-encapsulated phase change material is in the range of 22° to 28° C.

5. The coated article of claim 1, wherein the coating covers between 1 to 99 percent of the surface of the substrate.

6. The coated article of claim 5, wherein the coating covers between 50 to 90 percent of the surface of the substrate.

7. The coated article of claim 1, wherein at least two coating regions have different shapes or sizes.

8. The coated article of claim 1, wherein the coating regions have shapes that are independently selected from the group consisting of circular, half-circular, diamond-shaped, hexagonal, multi-lobal, octagonal, oval, pentagonal, rectangular, square-shaped, star-shaped, trapezoidal, triangular, and wedge-shaped.

9. The coated article of claim 1, wherein the coating regions have sizes ranging from 1 mm to 4 mm.

10. The coated article of claim 1, wherein the solid/solid phase change material comprises a polyhydric alcohol selected from the group consisting of 2,2-dimethyl-1,3-propanediol, 2-hydroxymethyl-2-methyl-1,3-propanediol, ethylene glycol, pentaerythritol, dipentaerythritol, pentaglycerine, tetramethylol ethane, neopentyl glycol, tetramethylol propane, 2-amino-2-methyl-1,3-propanediol, monoaminopentaerythritol, diaminopentaerythritol, and tris (hydroxymethyl)acetic acid.

* * * * *